US009751733B2

(12) United States Patent
Häbe et al.

(10) Patent No.: US 9,751,733 B2
(45) **Date of Patent: *Sep. 5, 2017**

(54) COLLAR BEARING FOR A TELESCOPIC BOOM AS WELL AS TELESCOPIC BOOM AND CRANE

(71) Applicant: Liebherr-Werk Ehingen GmbH, Ehingen (DE)

(72) Inventors: Engelbert Häbe, Ehingen (DE); Ralf Schörle, Ehingen (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 93 days.

This patent is subject to a terminal disclaimer.

(21) Appl. No.: 14/323,191

(22) Filed: Jul. 3, 2014

(65) Prior Publication Data

US 2015/0008207 A1 Jan. 8, 2015

(30) Foreign Application Priority Data

Jul. 4, 2013 (DE) ..... 10 2013 011 180 U

(51) Int. Cl.
*B66C 23/687* (2006.01)
*B66C 23/70* (2006.01)

(52) U.S. Cl.
CPC ..... *B66C 23/707* (2013.01); *B66C 23/701* (2013.01); *B66C 23/705* (2013.01); *B66C 23/708* (2013.01)

(58) Field of Classification Search
CPC ..... B66C 23/701–23/708
USPC ..... 212/292
See application file for complete search history.

(56) References Cited

U.S. PATENT DOCUMENTS

| | | | | |
|---|---|---|---|---|
| 7,686,174 | B2 * | 3/2010 | Willim | B66C 23/42 212/270 |
| 8,689,986 | B2 * | 4/2014 | Richter | B66C 23/344 212/177 |
| 9,376,293 | B2 * | 6/2016 | Willim | B66C 23/705 |
| 2003/0071004 | A1 * | 4/2003 | Higgins | B66C 23/701 212/292 |
| 2010/0282700 | A1 * | 11/2010 | Richter | B66C 23/36 212/177 |
| 2013/0020274 | A1 * | 1/2013 | Munuswamy | B66C 23/80 212/347 |
| 2015/0167342 | A1 * | 6/2015 | Montaner Fraguet | B66C 23/32 52/745.18 |

FOREIGN PATENT DOCUMENTS

DE 10 2008 062 648 A1 1/2010

* cited by examiner

*Primary Examiner* — Sang Kim
*Assistant Examiner* — Juan Campos, Jr.
(74) *Attorney, Agent, or Firm* — Dilworth & Barrese, LLP

(57) ABSTRACT

The invention relates to a collar bearing for a telescopic boom for the sliding support of two telescopic sections in the collar region of the outer telescopic section, wherein the collar bearing includes fixing means, whereby the collar bearing selectively is releasably connectable with the outer or inner telescopic section.

5 Claims, 5 Drawing Sheets a)

b)

COLLAR BEARING FOR A TELESCOPIC BOOM AS WELL AS TELESCOPIC BOOM AND CRANE

BACKGROUND OF THE INVENTION

This invention relates to a collar bearing for a telescopic boom for the sliding support of two telescopic sections in the collar region of the outer telescopic section.

Telescopic booms consist of an articulation section and several sections shiftably mounted in this articulation section. The drive for telescoping the boom is effected via a telescoping cylinder which is mounted at the end in the region of the bottom of the articulation section.

Depending on the dimensioning of the crane it can occur that the telescopic boom is too heavy for being transported with the crane. In this case, the telescopic boom is demounted for the transport and traveled to the site of use separate from the crane. In the case of very long and heavy telescopic booms it can be required to split the boom into individual telescopic sections or individual groups of telescopic sections for transport purposes and only mount the same at the site of use.

Individual telescopic sections of a telescopic boom usually are mounted one inside the other for a relative movement over various bearing points. At the inner telescopic section first bearing points therefore are provided on the outer circumference of the lower end. These bearing points are firmly fixed at the inner telescopic section and during the telescoping movement move along with the inner telescopic section. A second bearing point is provided at the outer telescopic section in the region of its collar. This bearing point, also referred to as collar bearing, is stationarily attached to the inner circumference of the collar.

For the assembly of a telescopic boom the collar bearing of the outer telescopic section must be removed, in order to insert the inner telescopic section into the cavity of the outer section. Up to now, no possibility is known for automatically mounting the collar bearing during the assembly operation.

SUMMARY OF THE INVENTION

The invention therefore deals with the finding of a suitable solution for the automatic assembly during the crane setup operation.

This object is solved by a collar bearing with the features herein. Advantageous aspects of the collar bearing are also subject-matter of the invention.

There is proposed a collar bearing for a telescopic boom for the sliding support of two telescopic sections in the collar region of the outer telescopic section. During the boom operation, the collar bearing should stationarily be mounted at the collar of the outer section and ensure a sliding support of the inner section. The outer section preferably can be the articulation section of the boom or a telescopic section mounted within the articulation section.

According to the invention, the collar bearing comprises fixing means, in order to releasably connect the same during the boom assembly at the site of use selectively with the outer or the inner telescopic section. For the boom assembly, the inner telescopic section is retracted into the interior space of the outer telescopic section by means of the telescoping cylinder. Although the inner bearing point of the inner telescopic section here comes to bear, a proper support or guidance of the inner telescopic section only is achieved by a proper installation of the second bearing point, i.e. of the collar bearing. Since the same is not mounted yet in the present state of assembly, the inner telescopic section can be retracted only very slowly.

The collar bearing according to the invention therefore comprises fixing means, in order to fix the same at the inner telescopic boom section at the beginning of assembly. By retracting the inner telescopic section, the collar bearing also moves in direction of the collar region of the outer telescopic section. At the target position, the collar bearing can be detached from the inner telescopic section by means of the fixing means and instead be attached to the outer telescopic section. The inner telescopic section then can freely slide in the second bearing point, i.e. the collar bearing according to the invention, for the telescoping operation.

It is particularly advantageous when the collar bearing includes a guide frame to which one or more sliding means are attached. The sliding means preferably are arranged such that the same lie between the inner and the outer telescopic section. One or more sliding means can be designed in the form of one or more bearing shoes which preferably are arranged on the frame side facing the inner section. Preferably, the one or more bearing shoes partly are embedded in the frame surface.

By means of the fixing means, the guide frame selectively can be fixable on the outer circumference of the inner telescopic section or on the inner circumference of the outer telescopic section in its collar region.

It is particularly advantageous when the shape of the guide frame is adapted to the shape of the section, so that the same extends around the entire circumference of the inner section.

The fixing means can include one or more bolts and/or one or more bolt receptacles. Particularly advantageously, the collar bearing includes at least one actuatable bolt for fixing at the inner telescopic section and at least one bolt receptacle for receiving a matching bolt of the outer telescopic section. All required bolts or bolt actuating devices just as well can be arranged at the collar bearing or at the respective sections.

Ideally, separate fixing means are provided for the fixation at the inner and outer telescopic section. This provides the possibility that the collar bearing or the guide frame first can be fixed at the inner and outer telescopic section, before a separation from one of the two telescopic sections is effected. An inadvertent shifting of the collar bearing or of the guide frame thereby is avoided.

The fixing means can have any kind of design. What is found to be expedient is a quadruple bolting for fixing at the inner telescopic section, for example such that per boom corner or frame corner exactly one bolt connection can be made.

At least one fixing means can be actuatable hydraulically. The supply of the individual fixing means or bolt connections for example can be providable by hydraulic supply via the articulation piece.

It is conceivable that the fixing means at least partly are automatic, i.e. even after interruption of the energy supply, the same are automatically held in their current position. This is necessary in particular when for the energy supply of the fixing means only a temporary supply line is to be provided.

Ideally, one or more monitoring means are provided at the collar bearing or at the guide frame, which jointly or separately monitor the current status of the individual fixing means and possibly communicate the same to a connected crane controller. Preferably, one or more monitoring means are designed in the form of one or more proximity switches, which monitor the current bolt position of the individual bolt connections and communicate the corresponding bolt position to the crane controller.

Beside the collar bearing, the invention relates to a telescopic boom for a crane which comprises at least one collar bearing according to the present invention or comprises a collar bearing according to an advantageous aspect of the invention.

The advantages and properties of the telescopic boom quite obviously correspond to those of the collar bearing according to the invention, so that a repetitive description will be omitted at this point.

According to a preferred aspect, at least one actuatable bolt, in particular a hydraulically actuatable bolt, is provided in the collar region of the at least one outer telescopic section for releasably fixing the collar bearing, in particular for the reversible engagement into a bolt receptacle of the collar bearing. Ideally, this bolt is dimensioned comparatively strong, i.e. stronger than the bolts of the guide frame.

Analogous to the collar bearing, monitoring means, in particular a proximity switch, also can be provided at the outer telescopic section for monitoring the bolt position of the at least one bolt of the outer telescopic section.

The telescopic boom preferably can be a telescopable lattice boom or a telescopable boom made of individual sheet-metal parts. A mixed form of lattice construction and sheet-metal construction is of course also conceivable.

The invention finally relates to a crane with a telescopic boom according to the present invention.

BRIEF DESCRIPTION OF THE DRAWINGS

Further advantages and properties of the invention will be explained in detail below with reference to an exemplary embodiment illustrated in the drawings, in which.

DESCRIPTION OF THE PREFERRED EMBODIMENTS

Figure 1:
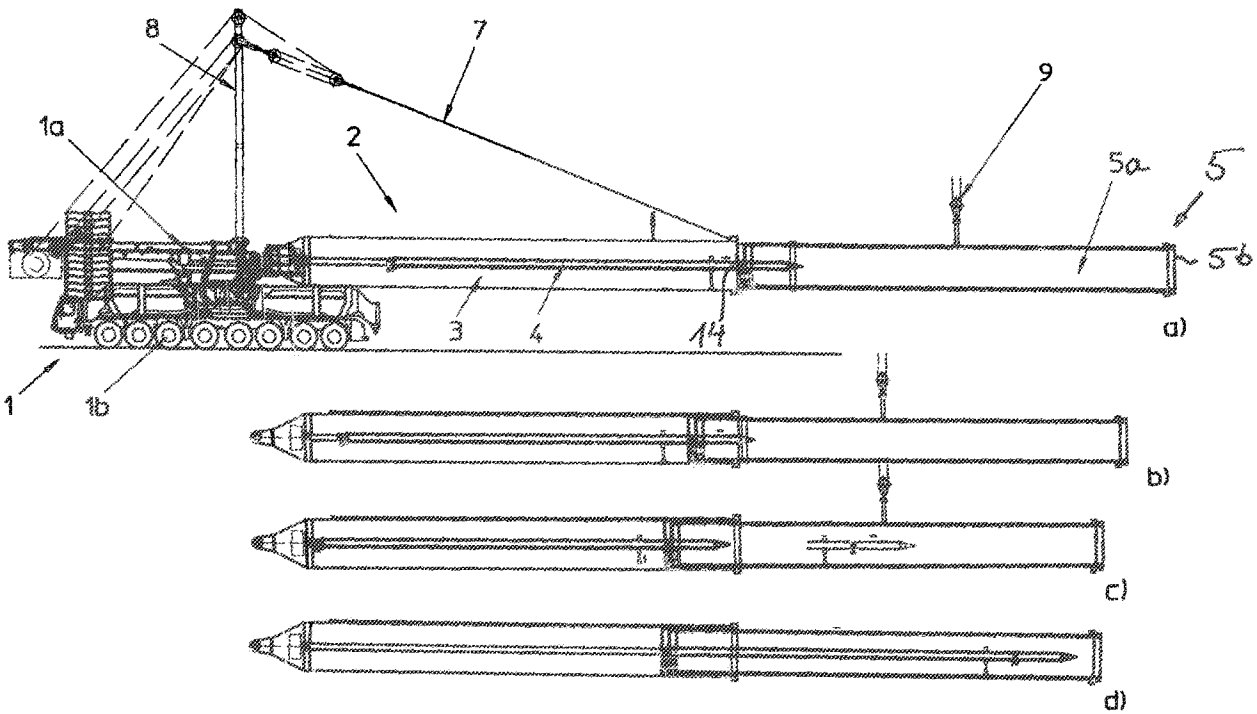
FIG. 1: shows the telescopic boom according to the invention during the individual assembly steps of the assembly method.

FIG. 1 shows a crane 1 with telescopic boom 2, which includes an articulation section 3, a telescopic cylinder 4 and at least one telescopic section 5. The telescopic boom 2 is transported to the site of use separate from the crane 1. For weight reasons, at least one telescopic section 5 or a telescopic section package consisting of a plurality of telescopic sections in addition is traveled separate from the articulation section 3 and subsequently mounted at the site of use by means of an auxiliary crane 9.

After the crane transport, the crane thus is brought into the operable condition at the construction site. For this purpose, the crane uppercarriage 1*a* is put onto the crane undercarriage 1*b*. Subsequently, the articulation section 3 is connected with the crane uppercarriage 1*a*. The articulation section 3 alone can represent a transport unit or alternatively also can already contain one or more telescopic sections 5. In any case, the telescoping cylinder 4 is present in the articulation section.

At its lower end, the telescoping cylinder 4 is connected with the foot of the articulation section 3. The opposite end of the telescoping cylinder 4 is exposed and can be extended in direction of the boom head.

Figure 2:
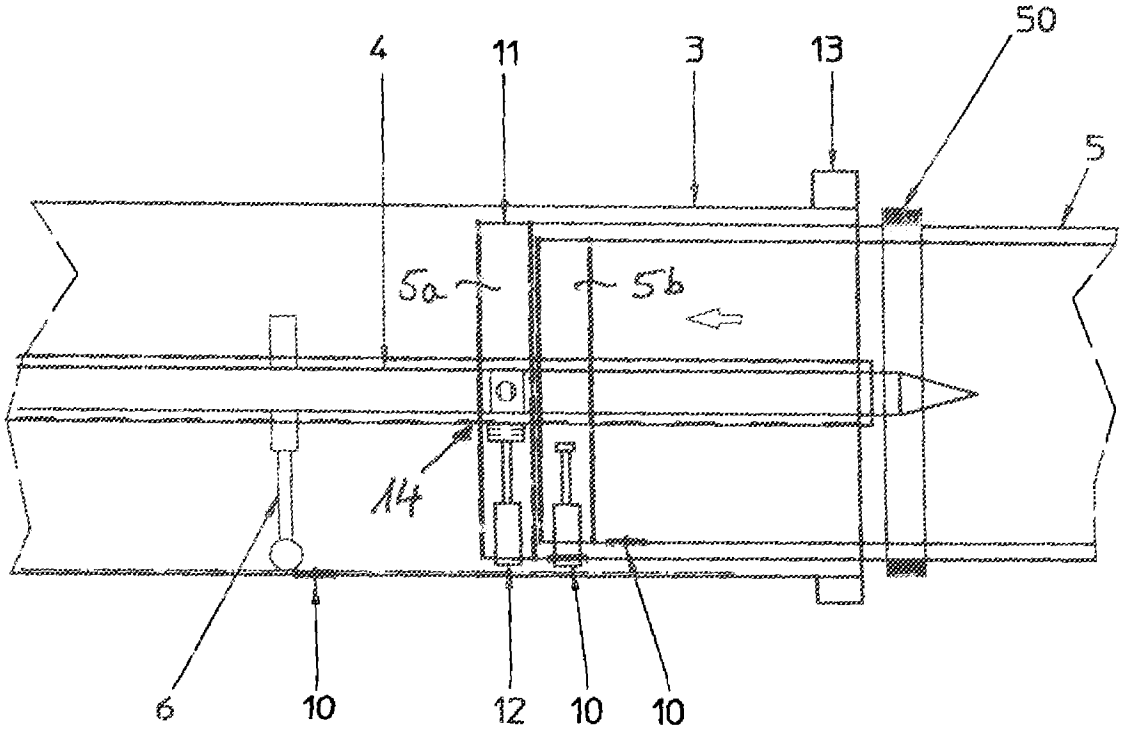
FIG. 2: shows a detail view of the telescopic boom according to the invention.

To keep the harmful moment away from the telescoping cylinder 4 during the push-out movement of the piston rod of the cylinder 4, the telescoping cylinder 4 is supported against the inside of the articulation section 3 by means of the active prop 6 (see FIG. 2). The prop 6 is variable in length and is actuated hydraulically. The hydraulic supply is effected via the hydraulic supply of the telescoping cylinder 4.

At the beginning of the assembly operation (see FIG. 1*a*), the articulation section 3 is kept horizontal by the guying 7 and the stay rack 8. The telescoping cylinder 4 is completely retracted and supports on the prop 6. A telescopic section package 5 to be mounted with the two telescopic sections 5*a*, 5*b* is fastened to the auxiliary crane 9 and brought into the assembly position in collar vicinity of the articulation section 3. The section 5*a* forms the outer telescopic section of the package 5. Both sections 5*a*, 5*b* are bolted to each other.

For the accommodation of the telescopic section package 5, in particular the outer telescopic section 5*a*, by the telescoping cylinder 4 the same must a little bit protrude into the interior space of the articulation section 3 at the end. To simplify this operation, insertion aids in the form of slopes are provided both at the articulation section 3 and at the telescopic section 5*a*. Furthermore, the telescopic section package 5 is accommodated by the auxiliary crane 9 with a small diagonal pull. The telescopic section package 5 thereby is pressed against the articulation section 3 and the provided slopes come to bear.

By introducing the package 5, a first centering is achieved and the first bearing point of the outer telescopic section 5*a* comes to bear.

As is known from the prior art, there is provided a connection system in the form of several bolt connections between adjacent telescopic sections. For example, this can be a quadruple bolting—according to the not pre-published patent application DE 10 2012 002 122—or also any other bolting, for example a bottom chord bolting according to the not pre-published patent application DE 10 2013 006 259. In the assembly position, the outer telescopic section 5*a* with its end piece 11 protrudes into the interior space of the articulation section 3 to such an extent that the bolt or bolts 12 of the telescopic section 5*a* rest against the collar 13 of the articulation section 3 (FIG. 1*a*). The overlap of the sections 3, 5*a* still is extremely small at this time.

In the following step, the telescoping cylinder is extended, until the auxiliary mounting head 14 according to the invention is in the actuating position for the actuatable bolt 12. The auxiliary mounting head 14 can connect itself with the telescopic section 5*a* and thereafter unlock the bolt 12, i.e. retract it in direction of the longitudinal axis of the telescopic section 5*a*, in order to eliminate a possible bolt connection or blockage of a relative movement. The telescopic section package 5 now is shiftable in the interior space of the articulation section 3.

By slowly retracting the telescoping cylinder 4, the telescopic section 5 is retracted into the articulation section 3. Since the essential part of the weight force of the telescopic section 5 is held by the auxiliary crane 9 and the first bearing point in the end region 11 of the telescopic section 5*a* already is in engagement with the articulation section 3, the auxiliary mounting head 14 can be designed very lightweight. Besides, not all safety functions need to be contained, since the auxiliary mounting head 14 exclusively operates in the unloaded state, i.e. in the setup state. Retracting the telescopic section package 5 is effected very slowly, since there is no complete support and exact guidance between the telescopic sections, i.e. the articulation section 3 and the telescopic section package 5. What is missing is the necessary second bearing point in the region of the collar 13 of the articulation section 3.

To ensure a simultaneous installation of the collar bearing during the installation of the telescopic section package 5, the guide frame 50 according to the invention (see FIG. 2), which is fixed on the outer circumference of the telescopic section 5*a*, also is pulled in direction of the collar 13 of the articulation section 3 together with the telescopic section 5*a*. This guide frame 50 contains the known and required second bearing point between the articulation section 3 and the telescopic section 5*a*. This bearing point also can be provided with the insertion aids already described above, whereby its assembly is simplified. The mode of operation of the guide frame 50 according to the invention will be referred to at a later time of the description and will be explained with reference to FIGS. 3 and 4.

The telescoping cylinder 4 retracts the telescopic section package 5 into the interior space of the articulation section 3 (see FIG. 1*c*), until the bolts 12 of the telescopic section 5*a* reach the matching counterpoints of the articulation section 3. After reaching the target position, the assembly head 14 releases the bolts 12 which then automatically are put into matching bores 10 of the counterelements 10 at the articulation section 3. At the same time or timely, the connection between mounting head 14 and telescopic section 5*a* is separated automatically.

On reaching the target position, the guide frame 50 has arrived at the collar 13 of the articulation section 3, whereby the second bearing point between articulation section 3 and telescopic section 5*a* is operable. The telescopic boom 2 now is ready for operation. If necessary, it is possible to in the same way mount further telescopic sections at the respective innermost telescopic section 5*b* by repeating the assembly operation. This target position can be reached already before reaching the bolting position between the telescopic sections.

Since the end piece 11 has a guide for the telescoping cylinder 4, the prop 6 can be retracted after assembly. The same no longer represents an obstacle and the telescoping cylinder 4 can easily be extended into the interior region of the inner telescopic section 5*b* (FIGS. 1*c*/1*d*). If necessary, the prop 6 can again be extended in the cavity of the telescopic section 5*b* and support against its inner wall, for example for mounting possibly existing additional telescopic sections.

After the assembly of the telescopic boom 2 is completed, the guying 7 is connected with the mounted telescopic section package 5, which is extended for the lifting work to be done. The hydraulic supply of the auxiliary mounting head 14 is effected by the already existing hydraulic supply of the telescoping cylinder 4. A supply of the active prop 6 also can be effected in this way.

Demounting the crane boom 2 analogously is effected in the reverse order. In general, the telescopic boom 2 can be designed in sheet-metal construction like in the illustrated exemplary embodiment. The method can however be applied without restrictions to telescopic booms in lattice construction or to boom systems which are composed of a mixed form of said types of construction.

Figure 3:
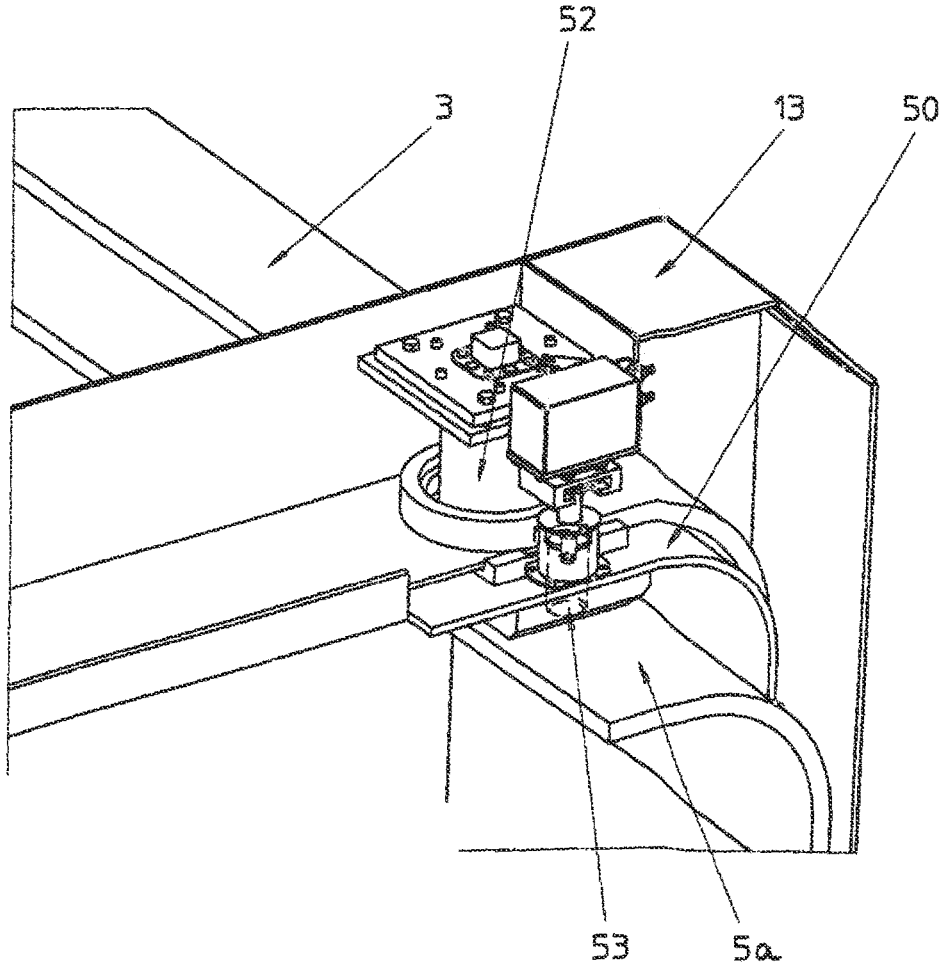
FIG. 3: shows a perspective detail view of the guide frame according to the invention.
Figure 4:
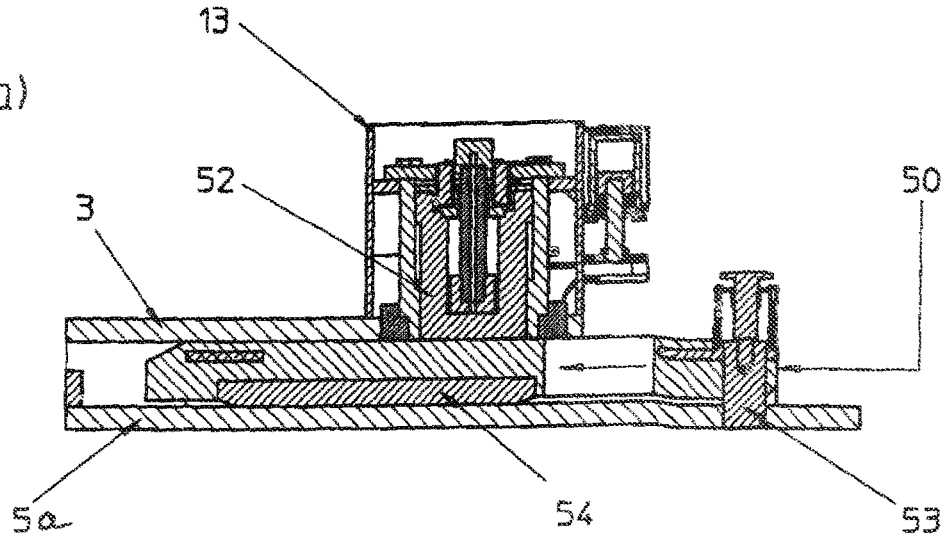
FIG. 4: shows various sectional representations through the guide frame according to the invention during different assembly steps.
Figure 4:
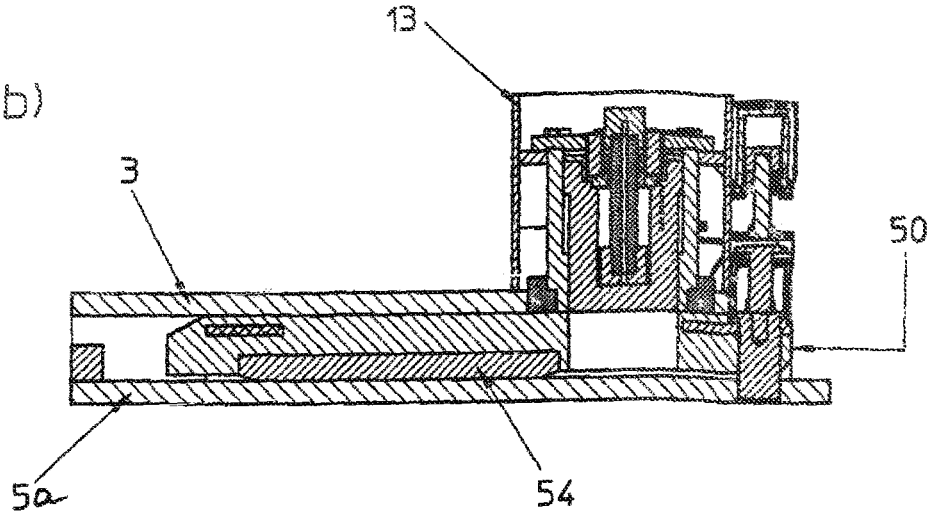
Figure 4:
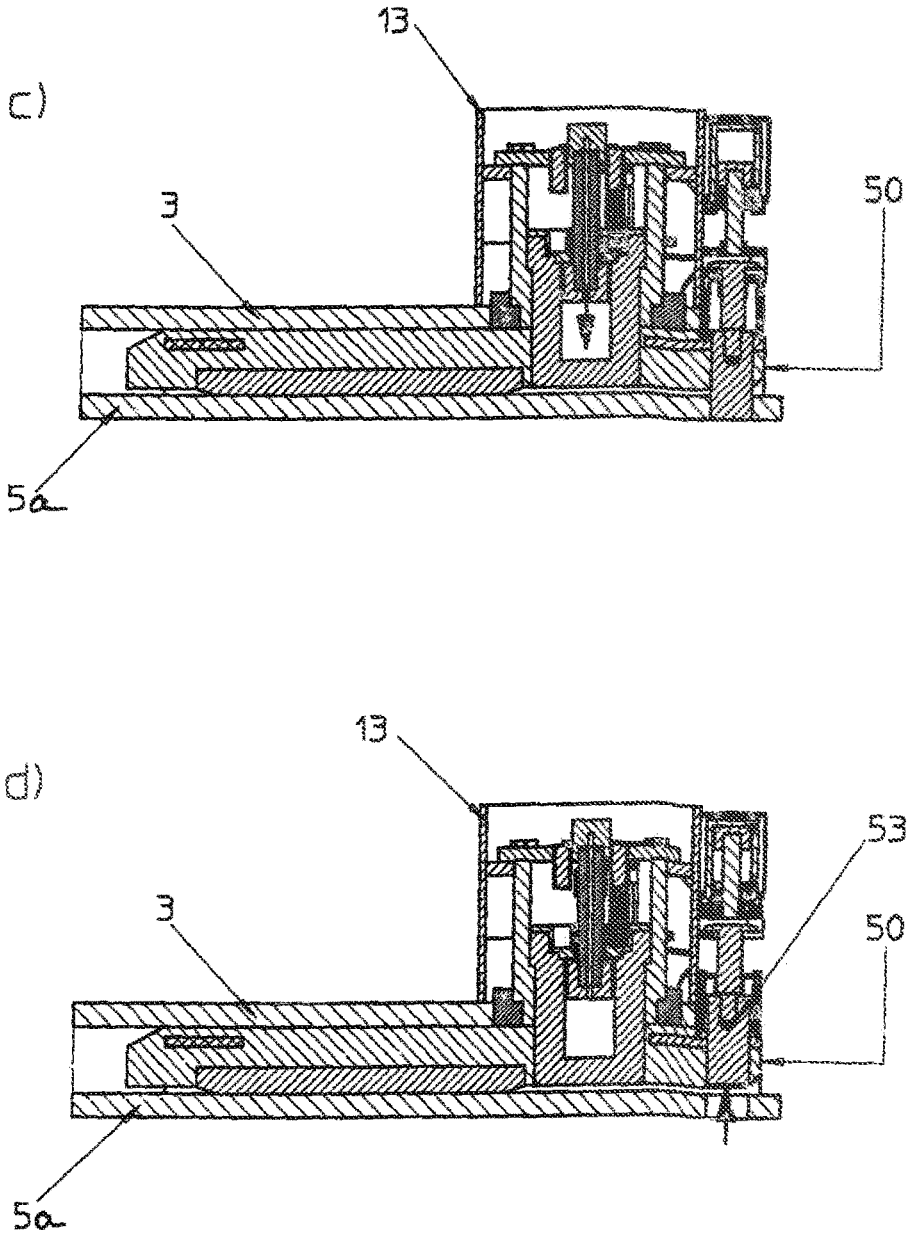

By means of the representations of FIGS. 3 and 4, the basic mode of operation of the guide frame 50 according to the invention will be discussed in detail below. At the beginning of the procedure, the guide frame 50 is sitting on the outer circumference of the telescopic section 5*a* (see FIGS. 1*a*, 1*b* and 2) and in this position is firmly connected with the telescopic section 5*a* via the connecting bolt 53, which is put into a matching bore on the outer circumference of the telescopic section 5*a*. The connection can be made via one or more bolt connections of the illustrated type. What is expedient is a quadruple bolting with one bolt connection each per frame corner.

The bolt mechanism of the connecting bolts 53 is automatic, so that after actuation the same remain in the respective position also without steady supply of energy.

When the telescopic section 5*a* is retracted into the interior space of the articulation section 3 by means of the telescoping cylinder 4, the guide frame 50 also moves in direction of the collar 13 of the articulation section 3, until the same reaches the intended position (FIG. 3 and from FIG. 4*b*) in the collar region of the articulation section 3. At the collar region a bolt mechanism with a strongly dimensioned bolt 52 is installed, which can be put into the matching bore of the guide frame 50. This bolt connection 52 ensures that the telescoping cylinder 4 does not inadvertently push out the guide frame 50. The guide frame 50 hence is firmly connected with the articulation section 3 and the telescopic section 5*a* (see FIG. 4*c*).

Subsequently, the at least one connecting bolt 53 is removed, in order to release the bolt connection between the guide frame 50 and the telescopic section 5*a*. The telescopic section 5*a* now can slide over the second bearing point stationarily connected with the collar 13 of the articulation section 3. The bearing point at the guide frame 50 is formed by the illustrated bearing shoe 54, which is arranged on the bottom side of the frame.

The supply lines, in particular hydraulic lines, preferably are guided outside the articulation section 3 in longitudinal direction of the boom. For supplying the further telescopic sections 5 according to the presented method, hydraulic connections between the sections are created manually by the crane operator and released again after assembly. It is therefore necessary that the respective connecting bolts 53 independently remain in the current bolt position also without hydraulic supply.

For monitoring the bolt position of the connecting bolts 53 and of the bolt 52, corresponding sensors can be arranged at the telescopic boom 2. What is particularly suitable is the integration of one or more proximity switches which detect the respective bolt position and communicate the same to the crane controller.

The invention claimed is:

1. A telescopic boom (2), comprising a collar bearing situated upon an outer hollow articulation section (3) and arranged for sliding support of two inner telescopic sections (5*a*, 5*b*) in a collar region of the outer hollow articulation section (3) arranged to receive the telescopic sections (5*a*, 5*b*) therein, wherein the collar bearing includes a collar (13) situated at an end of the articulation section (3), a guide frame (50) concentrically arranged between the outer articulation section (3) and an outermost telescopic section (5*a*) of said two telescopic section (5*a*, 5*b*), a first guide bolt (53) arranged to couple the guide frame (50) to the outermost telescopic section (5*a*) and reciprocatingly seating in a matching bore on an outer circumference of the outermost telescopic section (5*a*), and a second guide bolt (52) mounted at the collar (13) and arranged to reciprocatingly seat in a matching bore on the guide frame (50).

2. The telescopic boom (2) according to claim 1, wherein the guide frame has one or more sliding means.

3. The telescopic boom (2) according to claim 2, wherein the sliding means are in the form of one or more bearing shoes.

4. The telescopic boom (2) according to claim 1, wherein the first and second guide bolts are actuated hydraulically.

5. The telescopic boom (2) according to claim 1, wherein the first and second guide bolts are operated automatically.

* * * * *